United States Patent [19]

Kirkpatrick

[11] 4,073,208

[45] Feb. 14, 1978

[54] ANVIL STRUCTURE FOR ROTARY DIE CUTTING APPARATUS

[75] Inventor: Alan D. Kirkpatrick, Sparta, N.J.

[73] Assignee: Robud Co., Fairfield, N.J.

[21] Appl. No.: 776,257

[22] Filed: Mar. 10, 1977

[51] Int. Cl.[2] ..... B26D 7/20

[52] U.S. Cl. ..... 83/659; 83/347; 29/130; 93/58.2 R

[58] Field of Search ..... 83/346, 347, 659; 93/58.1, 58.2; 29/130

[56] References Cited

U.S. PATENT DOCUMENTS

| | | | |
|---|---|---|---|
| 3,353,460 | 11/1967 | Henc | 83/347 |
| 3,885,486 | 5/1975 | Kirkpatrick et al. | 83/347 X |

*Primary Examiner*—Willie G. Abercrombie

*Attorney, Agent, or Firm*—Carella, Bain, Gilfillan & Rhodes

[57] ABSTRACT

Anvil structure for use in rotary die cutting apparatus is disclosed to include a shaft mounted anvil head, a slip ring slidably mounted on the anvil head and a die blanket releasably secured to the slip ring.

11 Claims, 3 Drawing Figures

ANVIL STRUCTURE FOR ROTARY DIE CUTTING APPARATUS

BACKGROUND OF THE INVENTION

This invention pertains generally to die cutting. More specifically this invention relates to anvil structure for use in conjunction with die cutting apparatus, the anvil structure defining a reaction surface for the cutting rules of die cutting structure.

Rotary die cutting pertains to the art of cutting a moving workpiece, e.g. a continuously moving web or a sheet of material, without interrupting the movements of the workpiece. In typical applications moving webs or sheets of material such as cardboard and corrugated paperboard, are passed between a cutting roller and an anvil roller. Cutting elements known as cutting rules are mounted on the cutting roller for rotation therewith. The anvil roller is provided with a cylindrical cover known as a cutting die blanket which fits around the surface of the anvil roller and effectively increases its diameter by twice the blanket thickness. The axes of rotation of the cutting roller and the anvil roller are parallel and displaced by an amount such that at their points of closest proximity the cutting rules penetrate the surface of the die blanket.

As the cutting rules penetrate the surface of the die blanket a resistance to the penetration is developed which, for purposes of this application, is called a reaction force. Adjustment of the relative positions of the axes of rotation of the cutting die roller and the anvil roller is made to provide a degree of penetration and therewith a degree of reaction force sufficient to insure complete cutting of the moving web or sheet of material.

In conventional die cutting apparatus the shafts of the cutting roller and the anvil roller are mechanically inter-engaged through a gearing pair. The gear of the anvil roller shaft may have one less tooth than the gear of the cutting roller shaft or, for the same purpose as discussed below, the diameters of the rollers may be slightly different. The purpose of such structure is to create a difference in the velocity of rotation of the cutting and anvil rollers so that the cutting rules will not continuously strike the same positions on the die blanket. Rather, the disparity in rotation permits the cutting rules to strike a different point on the surface of the blanket at each successive rotation thus prolonging the life of the cutting blanket.

As is well recognized in the art, however, there occurs situations wherein rotating apparatus not structured for differing degrees of rotation are adapted for use as die cutting apparatus. Typical of such situtations is the adaptation of printer-slotter apparatus to perform a die cutting function. Thus, it has been known to provide a printer-slotter apparatus with a cutting rule on the slotter knife shaft and a die blanket on the slotter head shaft such as to permit the formation of a manufacturers' joint concurrently with the slotting function of the apparatus during the manufacture of a box.

It is well recognized, however, that the slotter knife shaft and slotter head shaft of conventional printer-slotter apparatus are geared such as to cause the shafts to rotate at the same speed. Further, the plane of passage of the workpiece through the apparatus is positioned between the shaft axes such that the tangential velocity of the roller surfaces at the plane of the workpiece is equal. Modification of this structure to provide for die cutting results in continuous striking of the anvil blanket in the same position thus causing localized wear and shortened blanket life.

In order to accommodate for the localized wear on the die blanket, it is has been proposed to provide sliding anvil blankets. Known sliding anvil blankets have taken three basic structures, one structure had included a urethane die blanket slidably mounted on an anvil head, which head is rigidly secured to the anvil shaft. This structure has been disadvantageous because the die blankets, after a degree of usage, tend to deform in such a manner as to interfere with the capability of the blanket to slide on the anvil head. Once no longer able to slide, the wear again becomes localized and the life of the blanket is unreasonably shortened.

The other two basic known structures are similar. Each includes an anvil head rigidly mounted to an anvil shaft and a slip ring slidably mounted thereon, the slip ring having a coating of material such as urethane bonded to its surface. One of the basic structures slidably mounts the slip ring in a slot formed in the anvil head. The other provides for the slip ring to be secured to the anvil head by circumferentially mounting lock rings. In both cases the structure has been found to be disadvantageous because wear of the urethane coating requires the entire slip ring structure to be either discarded or returned to the manufacturer for resurfacing either alternative is economically undesirable.

Yet another disadvantage of known structures has been the proximity of the cutting rules to a solid metallic surface such as the anvil head. In such cases, where the cutting rule may come in contact with the surface of the anvil head, the cutting rule is often damaged.

SUMMARY OF THE INVENTION

It is an object of the present invention, therefore, to provide a sliding anvil die structure wherein deformation of the die blanket does not result in reduction of the capability of the blanket to slide on the anvil head.

A further object of the present invention is to provide a sliding anvil die structure wherein the die blanket is easily replacable. Still another object of the present invention is to provide an anvil die structure wherein the cutting rules are precluded from coming into contact with the anvil die head.

These objects and others not enumerated are achieved by the anvil structure according to the present invention, one embodiment of which may include an anvil head, a slip ring slidably mounted on the peripheral surface of the anvil head; a die blanket mounted on the peripheral surface of the slip ring, and means for releasably locking the die blanket and the slip ring in rigid relationship.

BRIEF DESCRIPTION OF THE DRAWINGS

A more complete understanding of the present invention may be had from the following detailed description thereof particularly when read in the light of the accompanying drawings wherein.

DETAILED DESCRIPTION

As noted above, the present invention relates to anvil structure for use in conjunction with die cutting apparatus, the anvil structure defining a reaction surface for the cutting rules of die cutting structure.

Figure 1:
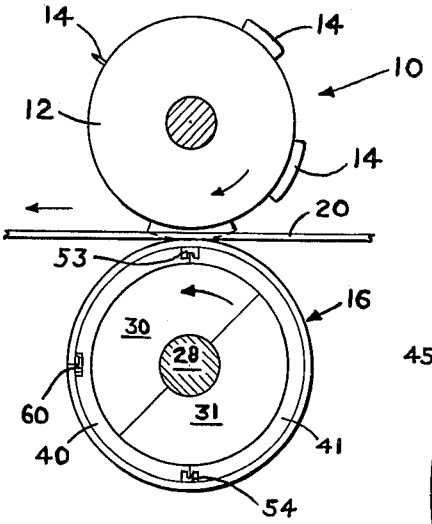
FIG. 1 is a schematic elevational view of die cutting apparatus incorporating a sliding anvil die structure according to the invention.

Referring therefore to FIG. 1, there is shown schematically a rotary die cutting structure designated generally by the reference numeral 10. Die cutting structure 10 is of the type which may be utilized to adapt apparatus such as a printer-slotter for accomplishing rotary die cutting.

Die cutting apparatus 10 includes a cutting roller 12 having a plurality of cutting knives or rules 14 mounted thereon and an anvil roller designated generally by the reference numeral 16, which anvil roller is structured in accordance with the teaching of the present invention.

Die cutting apparatus 10 is shown in FIG. 1 to be cutting a web of material 20, e.g. cardboard as it passes between rollers 12 and 16 from right to left as shown, As noted above, it may well be that the cutting is occurring substantially simultaneously with a printing slotting operation. Cutting roller 12 and anvil roller 16 rotate in the clockwise and counter-clockwise directions, respectively, at an angular rate which is such as to cause their surface velocities to be identical at their common line of tangency to the speed of advance of web 20.This relationship permits cutting of the web material in what is substantially a radially directed in and out motion. As is discussed below in detail, however, the anvil roller is provided with a blanket structure which is slidable around the periphery of the anvil head in response to the action of the cutting rules. This, of course, precludes the continuous subjection of individual localized areas of the blanket to wear. Rather the blanket wear is evenly distributed over its surface.

Figure 2:
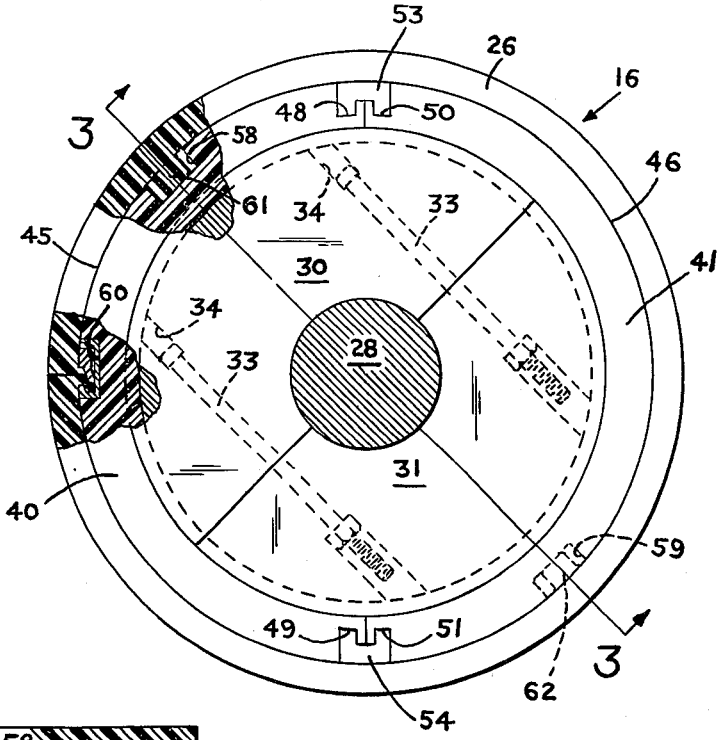
FIG. 2 is a cross-sectional elevational view of anvil die structure according to the invention taken generally through the center line plane of the anvil die structure.
Figure 3:
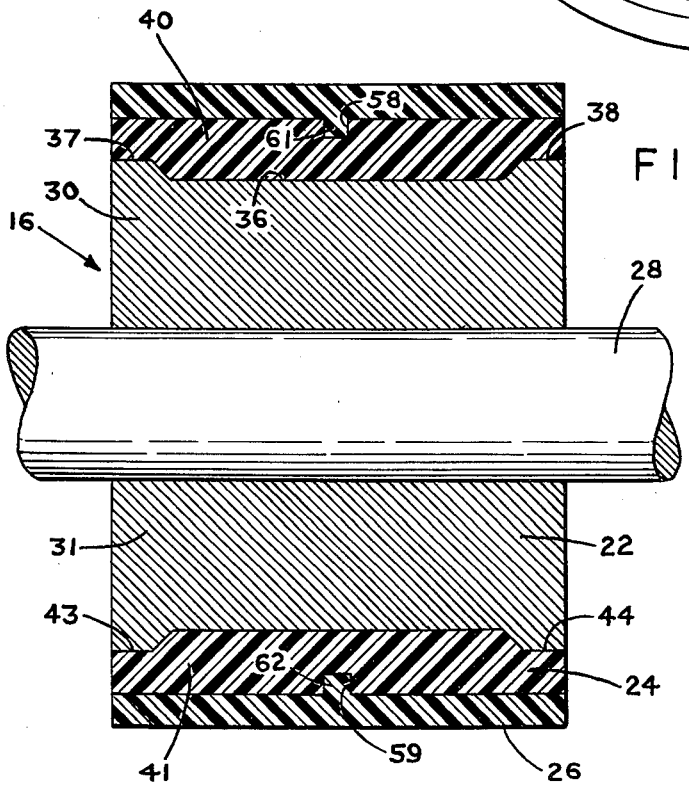
FIG. 3 is a cross-sectional view through the plane 3—3 of FIG. 2.

The present invention, however, is directed to novel anvil roller structure. Accordingly, specific reference is now made to FIGS. 2 and 3 which show a detailed elevational view and a cross-sectional view of anvil roller 16, respectively. Anvil roller 16 can be seen to comprise an anvil head 22, a slip ring 24 and a die blanket 26 all mounted on a shaft 28.

Anvil head 22 comprises a pair of half-head sections 30, 31 rigidly secured to shaft 28 by bolts 33 mounted in stepped bores 34 in the well known manner. When assembled, anvil head 22 is a generally cylindrical member which is relieved around its peripheral surface to define an annular channel 36 bounded by shoulders 37 and 38. The surfaces of channel 36 and shoulders 37 and 38 are machined to be smooth so as to permit slip ring 24 to be slidably mounted thereon.

Slip ring 24 comprises a pair of half-ring sections 40, 41 which when assembled define a generally cylindrical member having an inner surface which is the reverse of the peripheral surface of anvil head 22. More specifically, the inner surface of slip ring 24 is relieved at its edges to define a pair of annular channels 43, 44 which correspond in cross-sectional configuration to shoulders 37 and 38 of anvil head 22, respectively. The inside diameter of the major portion of slip ring 24 corresponds substantially to the diameter of channel 36 in anvil head 22. When slip ring 24 is assembled on anvil head 22, therefore, the inner surfaces of the slip ring are in surface-to-surface sliding engagement with the peripheral surface of anvil head 22. In this regard it should be noted that the permissable sliding engagement is limited to rotational relative movement. Relative transverse movement between slip ring 24, anvil head 22 is precluded by the cooperation of channels 43 and 44 with shoulders 37 and 38 respectively.

The structure of each half-section 40, 41 of slip ring 24 is identical. The external surfaces 45, 46 of each are cylindrical. The transverse edges of the peripheral surfaces 45, 46 are each relieved to define U-shaped channels 48, 49, 50 and 51. U-shaped channels, upon assembly of half-sections 40, 41 cooperate to define a pair of U-shaped channels in which is received a pair of U-shaped locking strips 53, 54. Thus, U-shaped locking strip 53 cooperates with channels 48 and 50 to lock half-sections 40, 41 together along one common transverse edge. Similarly, U-shaped locking strip 54 cooperates with channels 49 and 51 to lock half-sections 40, 41 together along their second common transverse edge. The outer surfaces of locking strips 53, 54 may be slightly rounded to cooperate with the outer surfaces 45, 46 of half-sections 40, 41 to define a smooth, consistent cylindrical surface.

In the embodiment shown, the outer surface 45 of half-section 40 is relieved to define a transversely extending channel 60. Channel 60 accommodates the reception therein of the locking elements of die blanket 26. In this regard, it has been found that superior operating results may be achieved through the use of a die cutting blanket having locking structure of the type disclosed in my co-pending application, Ser. No. 753,304, filed Dec. 22, 1976 for LOCK FOR ROTARY DIE CUTTING BLANKET. Thus, channel 60 may be structured to accommodate a blanket lock in accordance with the teaching of that invention. Alternatively, however, die blanket 26 may be secured to slip ring 24 in any other of the more conventional manners as are known to those skilled in these arts.

Also formed in the peripheral surfaces 45, 46 of half-sections 40, 41 are centrally disposed slots 58, 59. Slots 58, 59 extend partially through half-sections 40, 41 and are designed to accommodate, therein projections 61, 62 which are formed on the inner surface of blanket 26. Projections 61, 62 are received snugly transversely (FIG. 3) and loosely peripherally (FIG. 2) within slots 58, 59 respectively in order that they may be easily inserted yet preclude relative transverse movement between blanket 26 and slip ring 24.

In this regard, blanket 26 is a generally cylindrical structure having a locking structure formed on each transversely extending edge. As noted above the locking structure may be of the type disclosed in my above-identified co-pending application or it may be one of the previously known types. The major portion of the inner surface of blanket 26, when assembled, defines a cylindrical surface having a diameter substantially equal to the outside diameter of slip ring 24 such that the two components are in substantially total surface-to-surface engagement. The outside diameter of blanket 26 corresponds to the diameter desired to achieve optimum cutting results through the cooperation of cutting rules 14 and blanket 26.

The material of anvil head 22 may be any of the ordinarily accepted materials for such structures as are generally known by those having ordinary skill in these arts. The die blanket 26 may be of polyurethane, polyvinyl chloride, chlorinated butyl rubber and the like. The slip ring 24 may be manufactured from identical materials as the die blanket, or more desirably, it may be manufactured from a phenolic, e.g. 70–80 Shore D plastic material. Further, the respective elements may be manufactured utilizing techniques which are well known to those skilled in the art.

Assembly of anvil structure 16 is straightforward. Anvil head sections 31 and 32 are positioned on shaft 28 and rigidly secured thereto by bolts 33 cooperating with stepped bores 34 and suitable nuts or tapped bore sections as may be desired. Slip-ring half sections 40, 41 are then positioned around anvil head 22 such that the above-discussed surface-to-surface engagement is achieved. With the half-section so positioned locking elements 53 and 54 are inserted to effect rigid locking of the half-sections together. The assembly is then ready for mounting of the die blanket 26. Thus, projections 61 and 62 are inserted into slots 58 and 59, respectively. The blanket is smoothed over the surface of slip ring 24, the locking elements inserted within channel 60 and the blanket locked securely in place. The anvil assembly is at this stage ready for operation.

It will be obvious to those skilled in these arts that anvil assembly 16 has many advantages over known structures. Among the more significant, however, are that die blankets are readily replaceable when expended and that the wear of the die blanket with its often occurring attendant deformation is isolated from the inner surface of the slip ring such as to preclude interference with or damage to the sliding surface of the structure.

It will also be recognized by those having skills in these arts that many modifications and variations may be made to the disclosed embodiment without departing from the spirit and the scope of the invention.

What is claimed is:

1. Anvil structure for rotary die cutting apparatus, comprising:

an anvil head suitable for mounting on a rotatable shaft, said anvil head having a peripheral surface;

a slip ring, said slip ring including an inner surface which is slidable on said peripheral surface of said anvil head, said slip ring being slidably mounted on said anvil head;

die blanket means mounted on said slip ring; and means for releasably locking said die blanket means and said slip ring together.

2. Anvil structure according to claim 1 including an annular projection formed on one of said peripheral surface of said anvil head and said inner surface of said slip ring, and an annular channel formed on the other of said peripheral surface of said anvil head and said inner surface of said slip ring, said annular channel and said annular projection being in slidable surface-to-surface contact.

3. Anvil structure according to claim 1 including at least one annular projection and at least one annular channel formed in said peripheral surface of said anvil head, at least one annular channel, and at least least one annular projection formed in said inner surface of said slip ring, said at least one annular projection on said peripheral surface of said anvil head being in slidable surface-to-surface contact with said at least one annular channel in said inner surface of said slip ring, said at least one annular projection on said inner surface of said slip ring being in slidable surface-to-surface contact with said at least one annular channel in said peripheral surface of said anvil head, and wherein said annular projections and said annular channels cooperate to limit transverse sliding movement between said slip ring and said anvil head.

4. Anvil structure according to claim 1 wherein said slip ring comprises a pair of half-sections and said half sections are locked rigidly together by locking elements, and wherein said locking elements cooperate with the peripheral surfaces of said half-sections to define a cylindrical surface.

5. Anvil structure according to claim 1 wherein said die blanket includes an inner generally cylindrical surface and an outer generally cylindrical surface, said slip ring includes an outer generally cylindrical surface and said inner generally cylindrical surface of said die blanket is in surface-to-surface non-bonded contact with said outer generally cylindrical surface of said slip ring.

6. Anvil structure according to claim 3 wherein said die blanket includes an inner generally cylindrical surface and an outer generally cylindrical surface said slip ring includes outer generally cylindrical surface and said inner generally cylindrical surface of said die blanket is in surface-to-surface non-bonded contact with said outer generally cylindrical surface of said slip ring.

7. Anvil structure according to claim 5 including at least one slot formed in said outer surface of said slip ring and at least one projection formed on said inner surface of said die blanket, said slot and said projection being so positioned as to permit said projection to be received within said slot, said projection and said slot cooperating to limit transverse relative motion between said die blanket and said slip ring.

8. In an anvil structure for use in rotary die cutting, said anvil structure including an anvil head suitable for mounting on a rotatable shaft, and being of the type wherein a die blanket is rotatably slidable with respect to said anvil head, the improvement comprising:

a slip ring, said slip ring including an inner surface which is structured to be slidably mounted on an anvil head;

die blanket means slidably mounted on said slip ring; and means for releasably locking said die blanket means and said slip ring together.

9. An improvement according to claim 8 wherein said slip ring comprises a pair of half-sections and said half sections are locked rigidly together by locking elements, and wherein said locking elements cooperate with the peripheral surfaces of said half-sections to define a cylindrical surface.

10. An improvement according to claim 8 wherein said die blanket includes an inner generally cylindrical surface and an outer generally cylindrical surface, said slip ring includes an outer generally cylindrical surface and said inner generally cylindrical surface of said die blanket is in surface-to-surface non-bonded contact with said outer generally cylindrical surface of said slip ring.

11. An improvement according to claim 10 wherein an anvil structure including at least one slot formed in said outer surface of said slip ring and at least one projection formed on said inner surface of said die blanket, said slot and said projection being so positioned as to permit said projection to be received within said slot, said projection and said slot cooperating to limit transverse relative motion between said die blanket and said slip ring.

* * * * *